United States Patent [19]

Kido et al.

[11] Patent Number: 4,582,769

[45] Date of Patent: Apr. 15, 1986

[54] ELECTROPHOTOGRAPHIC ELEMENT WITH AMORPHOUS SI(C) OVERLAYER

[75] Inventors: Keishiro Kido; Kazuhiro Kawajiri; Hiroshi Sunagawa; Hiroshi Tamura; Mitsuo Saito, all of Kaisei, Japan

[73] Assignee: Fuji Photo Film Co., Ltd., Kanagawa, Japan

[21] Appl. No.: 596,718

[22] Filed: Apr. 4, 1984

[30] Foreign Application Priority Data

Apr. 4, 1983 [JP] Japan ..... 58-57975

[51] Int. Cl.[4] ..... G03G 5/082; G03G 5/14

[52] U.S. Cl. ..... 430/57; 430/66; 252/501.1; 427/74; 357/2

[58] Field of Search ..... 430/57, 66, 67; 252/501.1; 427/74; 357/2

[56] References Cited

U.S. PATENT DOCUMENTS

| | | | |
|---|---|---|---|
| 4,394,425 | 7/1983 | Shimizu et al. | 430/66 X |
| 4,443,529 | 4/1984 | Kanbe et al. | 430/67 X |
| 4,452,875 | 6/1984 | Ogawa et al. | 430/57 |
| 4,465,750 | 8/1984 | Ogawa et al. | 430/57 |

FOREIGN PATENT DOCUMENTS

| | | | |
|---|---|---|---|
| 57-115551 | 7/1982 | Japan | 430/67 |
| 57-115559 | 7/1982 | Japan | 430/67 |

*Primary Examiner*—Roland E. Martin

*Attorney, Agent, or Firm*—Gerald J. Ferguson, Jr.

[57] ABSTRACT

An electrophotographic photosensitive material comprising an electrically conductive support and a photoconductive layer of amorphous silicon containing a silicon atom and a hydrogen atom and/or a halogen atom provided said support, which comprises a low-photoconductive overcoat layer of amorphous silicon containing a carbon atom in a ratio of 5 to 35 atomic % on said photoconductive layer.

4 Claims, No Drawings

ELECTROPHOTOGRAPHIC ELEMENT WITH AMORPHOUS SI(C) OVERLAYER

BACKGROUND OF THE INVENTION

1. Field of the Invention

The present invention relates to an electrophotographic photosensitive material, and more particularly to an improvement in an electrophotographic photosensitive material using amorphous silicon as a photoconductive material.

2. Description of prior arts

Heretofore, as photoconductive materials used for formation of the photoconductive layer of electrophotographic sensitive material, there are known inorganic materials, such as amorphous selenium, selenium alloy, metallic compound semiconductors (for example, oxides, sulfides, selenides, etc. of cadmium, zinc, etc.); organic polymers such as polyvinyl carbazole, etc.; and organic compounds such as colorant, pigment, etc. Recently, there has been proposed an electrophotography using photoconductive amorphous silicon for the formation of the photoconductive layer of the electrophotographic photosensitive material.

As methods for forming the photoconductive layer of the electrophotographic photosensitive material composed of amorphous silicon, there are known, for example, a method wherein a powdery amorphous silicon is dispersed in a binder to form a photoconductive layer, and a method wherein a silicon-containing compound such as a silane or a silane derivative in the vapor form is decomposed by glow discharge and caused to be superposed on an electrically conductive support. Generally, these materials comprise basically an electrically conductive support and a photoconductive layer composed of amorphous silicon containing a silicon atom and a hydrogen atom and/or a halogen atom provided on said support.

However, such electrophotographic photosensitive materials comprising only an electrically conductive support and an amorphous silicon photoconductive layer have certain disadvantages so that there have been proposed improved methods, for example, a method wherein an intermediate layer is provided between the electrically conductive support and the amorphous silicon photoconductive layer, and a method wherein another layer is provided on the amorphous silicon photoconductive layer.

For example, the electrophotographic photosensitive material comprising only the electrically conductive support and the amorphous silicon photoconductive layer has a disadvantage in that the material is easily influenced by ambient temperature and humidity, so that the characteristics as the photosensitive material are liable to fluctuate, and further that the surface of the amorphous silicon photoconductive layer is easily oxidized by the corona charging (particularly negative-charging) to form an insulating oxidized film having high resistance on the surface of said photoconductive layer. If the photoconductive layer having the insulating oxidized film formed on the surface thereof is used for the electrophotographic process, there occurs lowering in the resolution of the formed image, i.e. formation of fog. Such lowering in resolution is thought to arise from the fact that when the corona discharge is carried out in the form of the image on the surface of the photoconductive layer having the insulating oxidized film formed on the surface thereon, a phenomenon that electric charges laterally migrate on the interface between the oxidized film and the photoconductive layer under the film.

In order to improve such drawback of the photosensitive material wherein the surface of the photosensitive layer is exposed to the outside, there is proposed in Japanese Patent Provisional Publication No. 57(1982)115559 a photoconductive member wherein a surface barrier layer containing a large amount of carbon atom is provided on the upper side of said photoconductive layer. In this photoconductive member, the surface barrier layer protects the photoconductive layer and inhibits the migration of electric charge on the charged surface into the photoconductive layer.

When the above-described surface barrier layer is provided on the surface of the photoconductive layer, it becomes possible to prevent the surface of said layer from oxidation, but when an electrophotographic process is carried out by using such photosensitive material composed of the amorphous silicon photoconductive layer having the surface barrier layer provided thereon, the surface barrier layer shows property of inhibiting the migration of electric charge. Accordingly, there occurs a problem in that the resolution of the formed image can not reach a satisfactory level from the initial stage of the electrophotographic process.

SUMMARY OF THE INVENTION

The present inventors have made studies for the purpose of obtaining a photosensitive material which is effective for the formation of an image with high resolution when used in an electrophotographic process and is capable of forming an image with high resolution even after the copying operation is repeated. As a result, the inventors have discovered that this purpose can be achieved by providing a low-photoconductive overcoat layer containing a relatively low amount of carbon atoms on the amorphous silicon photoconductive layer.

The present invention provides an electrophotographic photosensitive material comprising an electrically conductive support and a photoconductive layer of amorphous silicon containing a silicon atom and a hydrogen atom and/or a halogen atom provided on said support, which comprises a low-photoconductive overcoat layer of amorphous silicon containing a carbon atom in ratio of 5 to 35 atomic % on said photoconductive layer.

It is preferred that further 1 to 50 atomic % of a halogen atom, particularly fluorine atom, is incorporated into the amorphous silicon of the low-photoconductive overcoat layer of the present invention.

The surface of the photoconductive layer of the electrophotographic photosensitive material of the present invention is effectively prevented from oxidation by providing the low-photoconductive overcoat layer on the photoconductive layer composed of amorphous silicon. Further, in contrast to the case where an insulating layer is provided on the surface of the photoconductive layer to inhibit the migration of electric charge, there hardly occurs in the photosensitive material of the invention a phenomenon that electric charges laterally migrate on the interface between the overcoat layer and the photoconductive layer, so that when an electrophotographic process is carried out by using the photosensitive material of the present invention, there is given an advantage that the resolution of the resulting image is at a high level and such high resolution hardly lowers even after the copying operation is repeatedly carried out.

DETAILED DESCRIPTION OF THE INVENTION

The electrophotographic photosensitive material using the photoconductive layer composed of amorphous silicon as a photosensitive material comprises basically an electrically conductive support and a photoconductive layer composed of amorphous silicon of a silicon atom and a hydrogen atom superposed on said support. The constitution and the manufacturing process thereof are already known.

Examples of the manufacturing processes include a process in that an amorphous silicon photoconductive layer comprising a compound containing a silicon atom and a hydrogen atom or a mixture of such compounds is formed on the sheet of an electrically conductive metal such as aluminum, chromium, iron or an alloy thereof such as stainless steel and processes through glow discharge, sputtering process, CVD method or ion plating method.

The following illustrates the present invention by way of a manufacturing process utilizing glow discharge, which is a typical process for preparing the electrophotographic photosensitive material comprising the amorphous silicon photoconductive layer as the photosensitive material layer.

The method for forming the amorphous silicon photoconductive through glow discharge generally comprises generating glow discharge on an electrically conductive support to decompose a gaseous compound such as silane containing a silicon atom and a hydrogen atom (and/or a halogen atom) or a silane derivative brought about into contact with the support and to deposit amorphous silicon on the support.

Examples of such silanes and silane derivatives include silane, disilane, trisilane, tetrasilane, silicoethylene, silicoacetylene, disiloxane, silylamine, monochlorosilane, dichlorosilane, trichlorosilane, tetrachlorosilane, hexachlorodisilane, octachlorotrisilane, decachlorotetrasilane, dodecachloropentasilane, monofluorosilane, difluorosilane, trifluorosilane, tetrafluorosilane, hexafluorodisilane, octafluorotrisilane, monobromosilane, dibromosilane, tribromosilane, tetrabromosilane, hexabromodisilane, octabromotrisilane, monoiodosilane, diiodosilane, triiodosilane, tetraiodosilane, hexaiododisilane, octaiodotrisilane and compounds containing one silicon atom and two or more halogen atoms per molecule such as $SiBrCl_3$ and $SiCl_2F_2$. Such silanes and silane derivatives may be used either alone or as a mixture of two or more of them. If necessary, hydrogen gas or other may be used together therewith.

As an example of a method for decomposing these silicon-containing compounds by glow discharge to deposite amorphous silicon on the surface of an electrically conductive support, there may be mentioned, for example, a method wherein an electrically conductive support whose surface is cleaned is placed in a tightly closed apparatus such as a bell jar; the pressure within the apparatus is first reduced; glow discharge is performed on the surface of said support to remove gases adsorbed on the surface of said support; a silicon-containing compound such as silane ($SiH_4$) in the vapor form is introduced into the apparatus; and glow discharge is performed on the surface of said support under high vacuum to decompose the silicon-containing compound and to deposit an amorphous silicon layer on the surface of said support. The thickness of the so-formed photoconductive layer composed of amorphous silicon generally ranges from 5 to 100 μm.

According to the electrophotographic photosensitive material of the present invention, a low-photoconductive overcoat layer composed of amorphous silicon containing carbon atom in a ratio of 5 to 35 atomic %, preferably 15 to 35 atomic % is provided on the amorphous silicon photoconductive layer formed on the support as described above.

The above-mentioned low-photoconductive overcoat layer can be formed, for example, in the following manner.

While retaining the amorphous silicon photoconductive layer formed on the support as such in the apparatus such as a bell jar, a certain amount of a carbon atom-containing compound gas (fluorine atom is preferably contained in addition) together with the silicon-containing compound gas is introduced into the apparatus, and glow discharge is performed on the surface of the photoconductive layer under high vacuum to decompose the silicon atom-containing compound as well as the carbon atom-containing compound and to deposit a low-photoconductive overcoat layer of amorphous silicon containing a carbon atom in an amount specified as above.

The thickness of the so-formed overcoat layer composed of amorphous silicon containing carbon atom generally ranges from 0.005 to 0.3 μm.

Examples of said silicon atom-containing compounds are those used for the formation of the aforementioned photoconductive layer.

Examples of said carbon atom-containing compounds include hydrocarbons having from 1 to 5 carbon atoms such as methane, ethane, propane, n-butane, isobutane, n-pentane, isopentane, ethylene, propylene, 1-butene, isobutylene, 1-pentene, 2-pentene, acetylene, methacetylene, butyne, etc.; and halogenated alkyls such as methyl fluoride, ethyl fluoride, propyl fluoride, methyl chloride, ethyl chloride, methyl bromide, ethyl bromide, methyl iodide, methylene fluoride, methylen chloride, hexafluoroethane, etc. Such compounds may be used either alone or as a mixture of two or more of them.

Since it is preferred that 1 to 50 atomic % of halogen atom, particularly fluorine atom, is incorporated into the amorphous silicon of the low-photoconductive overcoat layer in addition to carbon atom, it is desirable to use an alkyl halide, particularly an alkyl fluoride such as methylene fluoride or hexafluoroethane as the carbon atom-containing compound.

The mixing ratio of the silicon atom-containing compound to the carbon atom-containing compound in the mixed gas used for the formation of the low-photoconductive overcoat layer varies depending upon the atomic ratio of carbon atom in the desired overcoat layer. Theoretically, the atomic ratio of carbon atom in the formed overcoat layer agrees with that of the carbon atom in the mixed gas. However, the atomic ratio of carbon atom in the formed overcoat layer is practically smaller than that of the carbon atom in the mixed gas so that it is desirable to set the mixing ratio of the silicon atom-containing compound to the carbon atom-containing compound in the mixed gas, taking the above tendency into consideration.

It will be understood that modifications can be made in the photosensitive material of the present invention, for example, an intermediate layer between the electrically conductive support and the amorphous silicon photoconductive layer can be provided, if desired.

The following examples and comparison examples are provided to illustrate the present invention.

EXAMPLE 1

The following operation was carried out by using a bell jar-type glow discharge apparatus for the preparation of amorphous silicon, said apparatus being equipped with a vacuum system, a gas supply-piping system, a gas leak system, a heater and a glow discharge device.

A drum (support, 120 mm in outer diameter and 410 mm in length) made of aluminum, whose surface was abraded, was set on a quartz plate mounted on a rotating support table within the bell jar.

The bell jar and the gas pipe system, with which the bell jar was equipped, were evacuated so that the pressure within these systems was adjusted to the degree of vacuum of about $3\times10^{-5}$ Torr (mmHg).

The aluminum drum was heated while controlling the temperature to 250° C. by a heater provided in the bell jar. The control of the temperature was conducted while measuring the temperature of the drum with an alumelchromel thermocouple. Then, a leak valve was slightly opened to adjust the degree of vacuum within the bell jar to about 0.3 Torr, and glow discharge between the drum and a gas blow-off plate was performed for five minutes by input power of 30 W from a negative pulsating current high-voltage power source (hereinafter referred to simply as high-voltage power source) to remove gases adsorbed on the surface of the drum. After the high-voltage power was shut off and the leak valve was close, the pressure within the bell jar was adjusted to the degree of vacuum of above $1\times10^{-5}$ Torr.

$B_2H_6$ diluted with 290 ppm (in volume) of hydrogen (hereinafter referred to simply as $B_2H_6/H_2$) was supplied through the gas supply-pipe system at a flow rate of 4 cc/min. (SCCM) while adjusting the flow rate with a mass flowmeter. The valve of a $SiH_4$ gas supply-pipe system was gradually opened, and said gas was supplied at a flow rate of 150 cc/min. while adjusting the flow rate with a mass flowmeter. In this operation, the pressure within the bell jar was adjusted to $4.5\times10^{-1}$ Torr by controlling a by-pass valve.

When the flow rate of the supply gases was made constant, glow discharge between the rotating drum and the gas blow-off plate was performed for five hours by input power of 100 W to form an amorphous silicon photoconductive layer.

Before the formation of an overcoat layer began, the gas supply-pipe system was closed and the pressure within the bell jar was adjusted to the degree of vacuum of $1\times10^{-5}$ Torr.

At the time when the pressure within the bell jar was adjusted to $1\times10^{-5}$ Torr, the mass flowmeter of the $SiH_4$ gas supply-pipe system was adjusted to 30 cc/min., and that of the $C_6F_6$ gas supply-pipe system was adjusted to 8 cc./min. and these gases were supplied to the bell jar. At the time when the degree of vacuum within the bell jar reached $5\times10^{-3}$ Torr, the mass flowmeter of the $SiH_4$ gas supply-pipe system was adjusted to 150 cc/min. and that of the $C_2F_6$ gas supply-pipe system was adjusted to 32 cc/min. When the flow rates of these gases reached the preset value, the pressure within the bell jar was adjusted to $4.5\times10^{-1}$ Torr using the by-pass valve.

Glow discharge was then performed for three minutes by input power of 100 W from high-voltage power source to form an overcoat layer.

The high-voltage power source was shut off, and glow discharge was terminated. At the time when the pressure within the bell jar reached $5\times10^{-2}$ Torr, evacuation was carried out for ten minutes under the degree of vacuum of $1\times10^{-5}$ Torr. The heater was then switched off. When the temperature of the drum reached 100° C., the drum was taken out of the bell jar.

The thickness of the amorphous silicon layer formed on the drum was 37 μm as a whole. The thickness of the overcoat layer (i.e., low-photoconductive overcoat layer) out of the entire thickness was about 0.11 μm. The atomic ratio of carbon in the overcoat layer was about 30 atomic %.

The electrophotographic photosensitive material obtained by the above-described procedure was subjected to corona discharge under conditions that charging time was 0.08 seconds with positive 6 KV by a charging exposure experiment, and image exposure was immediately carried out for 0.6 lux.-sec. A developer consisting of a negatively chargeable toner and a carrier was placed on the drum surface of the photosensitive material by a magnetic brush method. The image was transferred on a transfer paper by positive corona discharge. There was reproduced a very sharp image with high resolution and high image density.

In order to evaluate the performance of the photosensitive material, a printing endurance test was carried out by repeating the above-described operation. Even after the photosensitive material was subjected to the printing endurance test for 50,000 sheets, the sharp image was still reproduced without forming fog on the image and reducing the image density.

EXAMPLE 2

The procedure of Example 1 was repeated except that the ratio of the supply amounts of silane gas and hexafluoroethane during glow discharge in the stage for forming the overcoat layer was changed so that $C_2F_6$ was supplied at a rate of 4 cc/min., while $SiH_4$ was supplied at a rate of 150 cc/min. Thus, a photosensitive material was prepared by depositing successively an amorphous silicon photoconductive layer and then an overcoat layer on an aluminum drum. The thickness of the amouphous silicon layer formed on the drum was 37 μm as a whole. The thickness of the overcoat layer out of the entire thickness was about 0.14 μm. The atomic ratio of carbon in the overcoat layer was about 5 atomic %.

The electrophotographic photosensitive material prepared by the above procedure was subjected to an electrophotographic operation in a similar manner to that described in Example 1. There was reproduced a very sharp image with high resolution and high image density on a paper.

In order to evaluate the performance of the photographic material, the printing endurance test was carried out by repeating the above operation. Even after the material was subjected to the printing endurance test for 10,000 sheets, the sharp image was still reproduced without forming fog in the image and reducing the image density.

COMPARISON EXAMPLE 1

The procedure of Example 1 was repeated except that the formation of the overcoat layer was omitted to produce a photosensitive material composed of the aluminum drum and only the amorphous silicon photoconductive layer was deposited on the drum.

The thickness of the amorphous silicon layer formed on the drum was 37 μm.

The electrophotographic photosensitive material prepared by the above procedure was subjected electrophotographic operation in a similar manner to that described in Example 1. There was reproduced a sharp image with high resolution and high image density on the first paper.

In order to evaluate the performance of the photosensitive material, the printing endurance test was carried out by repeating the above operation. At the time when the copying operation was repeated about 4,000 times, fog appeared the image and reduction of the image density was observed.

COMPARISON EXAMPLE 2

The procedure of Example 1 was repeated except that the ratio of the supply amounts of silane gas and hexafluoroethane during glow discharge in the formation stage of the overcoat layer was changed so that $C_2F_6$ was supplied at a rate of 75 cc/min., while $SiH_4$ was supplied at a rate of 150 cc/min. Thus, a photosensitive material was prepared by depositing successively an amorphous silicon photoconductive layer and then an overcoat layer on an aluminum drum. The entire thickness of the amorphous silicon layer formed on the drum was 37 μm. The thickness of the overcoat layer out of the entire thickness was about 0.14 μm. The atomic ratio of carbon in the overcoat layer was about 45 atomic %.

The electrophotographic photosensitive material prepared as above was subjected to an electrophotographic operation in a similar manner to that described in Example 1. There appeared fog in the image even on the first paper, and the image density was insufficient.

COMPARISON EXAMPLE 3

The procedure of Example 1 was repeated except that the ratio of the supply amounts of silane gas and hexafluoroethane during glow discharge in the formation stage of the overcoat layer was changed so that $C_2F_6$ was supplied at a rate of 61 cc/min., while $SiH_4$ was supplied at a rate of 150 cc/min. Thus, a photosensitive material was produced by depositing successively an amorphous silicon photoconductive layer and then an overcoat layer on an aluminum drum. The entire thickness of the amorphous silicon layer formed on the drum was 37 μm. The thickness of the overcoat layer out of the entire thickness was about 0.14 μm. The atomic ratio of carbon in the overcoat layer was about 40 atomic %.

The electrophotographic photosensitive material prepared as above was subjected to an electrophotographic operation in a similar manner to that described in Example 1. There was reproduced a sharp image with high resolution and high density on the first paper.

In order to evaluate the performance of the photosensitive material, the printing endurance test was carried out by repeating the above operation. At the time when the copying operation was repeated several times, there appeared fog in the image and reduction in the image density was observed.

We claim:

1. An electrophotographic photosensitive material comprising an electrically conductive support and a photoconductive layer of amorphous silicon containing a silicon atom and a hydrogen atom and/or a halogen atom provided on said support, and further comprising a low-photoconductive overcoat layer of amorphous silicon containing a carbon atom in a ratio of 5 to 35 atomic % on said photoconductive layer.

2. The electrophotographic photosensitive material as claimed in claim 1, wherein a halogen atom is incorporated in the amorphous silicon of the low-photoconductive overcoat layer in an amount of 1 to 50 atomic %.

3. The electrophotographic photosensitive material as claimed in claim 2, wherein said halogen atom is a fluorine atom.

4. The electrophotographic photosensitive material as claimed in any one of claims 1 to 3, wherein the thickness of the low-photoconductive layer ranges from 0.005 to 0.3 μm.

* * * * *